US010557654B2

(12) United States Patent
Fukuda et al.

(10) Patent No.: US 10,557,654 B2
(45) Date of Patent: Feb. 11, 2020

(54) COLLECTIVE DEVICE FOR SWITCHING REFRIGERANT FLOW

(71) Applicant: HITACHI-JOHNSON CONTROLS AIR CONDITIONING, INC., Tokyo (JP)

(72) Inventors: Kazunori Fukuda, Tokyo (JP); Koji Naito, Tokyo (JP); Kazuhiro Tsuchihashi, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 16/239,776

(22) Filed: Jan. 4, 2019

(65) Prior Publication Data

US 2019/0137154 A1 May 9, 2019

Related U.S. Application Data

(63) Continuation of application No. PCT/JP2017/012566, filed on Mar. 28, 2017.

(30) Foreign Application Priority Data

Jul. 11, 2016 (JP) ..... 2016/136577

(51) Int. Cl.
*F25B 41/04* (2006.01)
*F24F 1/20* (2011.01)
(Continued)

(52) U.S. Cl.
CPC ..... *F25B 41/046* (2013.01); *F24F 1/20* (2013.01); *F24F 1/30* (2013.01); *F25B 13/00* (2013.01);
(Continued)

(58) Field of Classification Search
CPC .....
F25B 41/04; F25B 41/046; F25B 2313/0231; F25B 2313/025;
(Continued)

(56) References Cited

U.S. PATENT DOCUMENTS

2012/0006042 A1* 1/2012 Wyer ..... F24T 10/10 62/238.7
2015/0300714 A1* 10/2015 Ishimura ..... F25B 13/00 62/225
(Continued)

FOREIGN PATENT DOCUMENTS

EP 2365254 A2 9/2011
JP 03-61794 A 3/1991
(Continued)

OTHER PUBLICATIONS

International Search Report of PCT/JP2017/012566 dated Jun. 6, 2017.

*Primary Examiner* — Edward F Landrum
*Assistant Examiner* — Daniel C Comings
(74) *Attorney, Agent, or Firm* — Mattingly & Malur, PC

(57) ABSTRACT

An collective device for switching refrigerant flow arranged between an indoor device and an outdoor device is provided; which includes multiple high-pressure valves; multiple low-pressure valves; a high-pressure header; a low-pressure header; a high-pressure gas pipe connecting each high-pressure valve and the high-pressure header; and a low-pressure gas pipe connecting each low-pressure valve and the low-pressure header, wherein the multiple high-pressure valves are arranged next to each other in a first direction perpendicular to a vertical direction, the multiple low-pressure valves are arranged next to each other in the first direction, and the low-pressure valves, the low-pressure header, and the low-pressure gas pipe are arranged on one side in a second direction perpendicular to the vertical
(Continued)

direction and the first direction with respect to the high-pressure valves, the high-pressure header, and the high-pressure gas pipe.

8 Claims, 4 Drawing Sheets

(51) Int. Cl.
*F24F 1/30* (2011.01)
*F25B 13/00* (2006.01)

(52) U.S. Cl.
CPC ... *F25B 2313/025* (2013.01); *F25B 2313/027* (2013.01); *F25B 2313/0231* (2013.01); *F25B 2500/01* (2013.01)

(58) Field of Classification Search
CPC ... F25B 2313/027; F25B 2500/01; F24F 1/20; F24F 1/30
See application file for complete search history.

(56) References Cited

U.S. PATENT DOCUMENTS

| | | | | |
|---|---|---|---|---|
| 2016/0356516 | A1 | 12/2016 | Eguchi et al. | |
| 2016/0377332 | A1 | 12/2016 | Eguchi et al. | |
| 2017/0089623 | A1* | 3/2017 | Kamitani | F16K 51/00 |

FOREIGN PATENT DOCUMENTS

| | | | | |
|---|---|---|---|---|
| JP | 2008-039276 | A | 2/2008 | |
| JP | 2013-117366 | A | 6/2013 | |
| JP | 2015-114048 | A | 6/2015 | |
| JP | 2015-114049 | A | 6/2015 | |
| JP | 2015-227741 | A * | 12/2015 | F24F 1/30 |

* cited by examiner

COLLECTIVE DEVICE FOR SWITCHING REFRIGERANT FLOW

CROSS-REFERENCE TO RELATED APPLICATION

This application is a continuation application of PCT/JP2017/012566, filed on Mar. 28, 2017, which claims the benefit of priority to Japanese Patent Application No. 2016-136577 filed with the Japan Patent Office on Jul. 11, 2016, the disclosures of all of which are hereby incorporated by reference in their entireties.

TECHNICAL FIELD

The present disclosure relates to a collective device for switching refrigerant flow.

BACKGROUND ART

Typically, there has been a collective device for switching refrigerant flow arranged between an outdoor device and an indoor device of an air conditioning system to switch a refrigerant flow. The collective device for switching refrigerant flow includes a first gas pipe provided with a switching valve and connecting a high-pressure valve and a low-pressure valve, and a second gas pipe connecting the first gas pipe and the indoor device. For arranging this collective device for switching refrigerant flow in a ceiling and charging this collective device for switching refrigerant flow with foam, the size of the collective device for switching refrigerant flow in a height direction needs to be reduced, and the collective device for switching refrigerant flow needs to be compact.

For solving these problems, Japanese Patent Application Publication No. 2015-114049 discloses, for example, a refrigerant flow path switching device arranged between a heat source device and a utilization device forming a refrigerant circuit to switch a refrigerant flow. The refrigerant flow path switching device includes a first refrigerant pipe connected to a suction gas communication pipe extending from the heat source device, a second refrigerant pipe connected to a high/low-pressure gas communication pipe extending from the heat source device, a third refrigerant pipe connected to a gas pipe extending to the utilization device, a coupling portion connected to the first, second, and third refrigerant pipes and coupling the first, second, and third refrigerant pipes to each other, a first switching valve arranged at the first refrigerant pipe, and a second switching valve arranged at the second refrigerant pipe. The second switching valve is arranged at a position higher than the first switching valve. The third refrigerant pipe has the lowermost portion at a position with the lowest height, and at the lowermost portion, is connected to the coupling portion (see claim 1).

SUMMARY OF THE INVENTION

In the refrigerant flow path switching device described in Japanese Patent Application Publication No. 2015-114049, one pipe connected to the high-pressure valve is provided vertically. There is a problem that when other pipes pass below the high-pressure valve and the above-described pipe, the dimension of the refrigerant flow path switching device in a height direction thereof is large.

For this reason, the present disclosure is intended to provide a collective device for switching refrigerant flow with a reduced height dimension.

For solving such a problem, the collective device for switching refrigerant flow according to a present embodiment is a collective device for switching refrigerant flow arranged between an indoor device and an outdoor device, including: multiple high-pressure valves; multiple low-pressure valves; a high-pressure header; a low-pressure header; a high-pressure gas pipe connecting each high-pressure valve and the high-pressure header; and a low-pressure gas pipe connecting each low-pressure valve and the low-pressure header, wherein the multiple high-pressure valves are arranged next to each other in a first direction perpendicular to a vertical direction, the multiple low-pressure valves are arranged next to each other in the first direction, and the low-pressure valves, the low-pressure header, and the low-pressure gas pipe are arranged on one side in a second direction perpendicular to the vertical direction and the first direction with respect to the high-pressure valves, the high-pressure header, and the high-pressure gas pipe.

According to the present disclosure, the collective device for switching refrigerant flow with the reduced height dimension can be provided.

DESCRIPTION OF THE EMBODIMENTS

Figure 1:
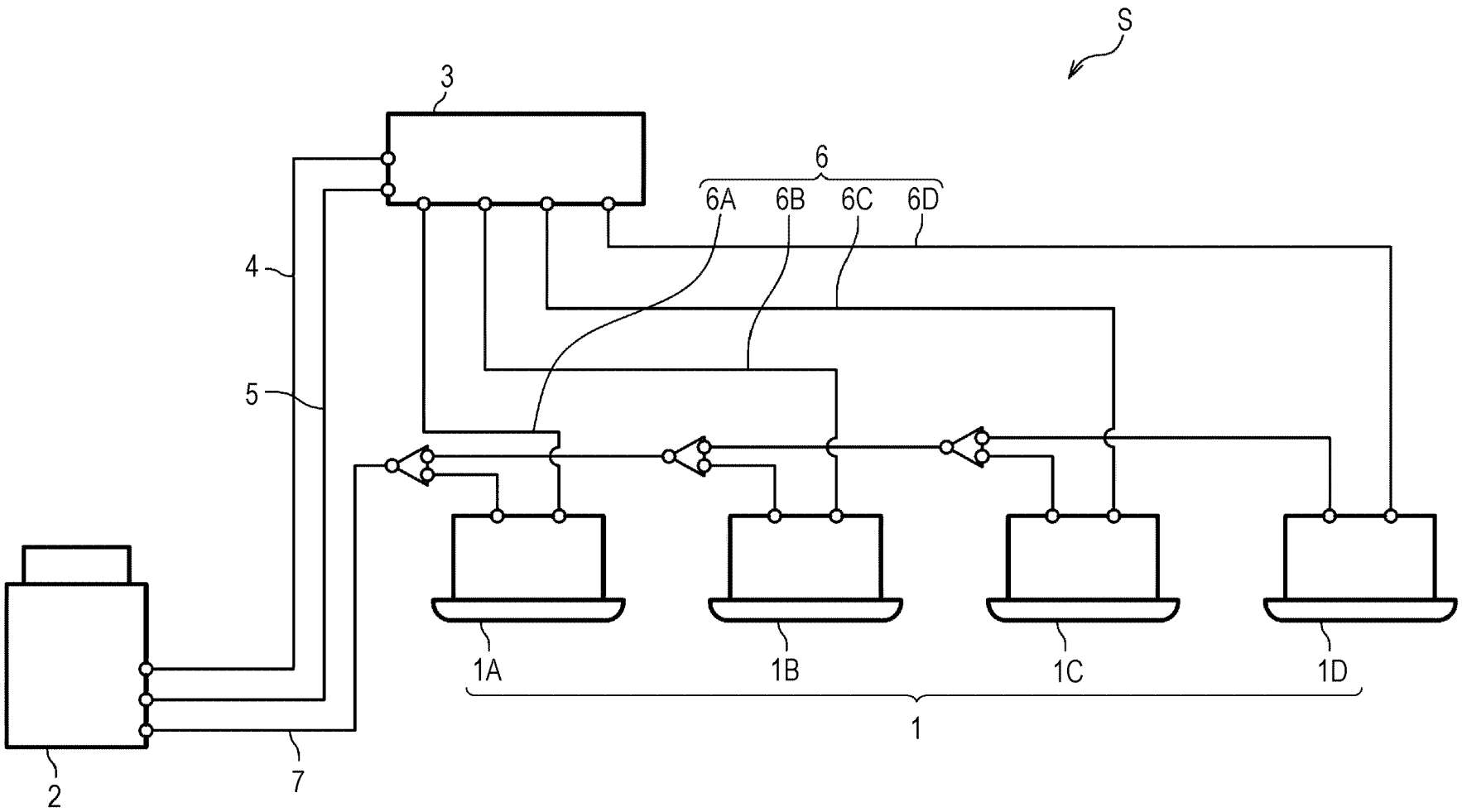
FIG. 1 is an entire configuration diagram of an air conditioning system including a collective device for switching refrigerant flow according to the present embodiment.

Hereinafter, the present embodiments will be described in detail with reference to the drawings, as necessary. Note that in each figure, the same reference numerals are used to represent common elements, and overlapping description will be omitted.

<<Air Conditioning System S>>

Figure 2:
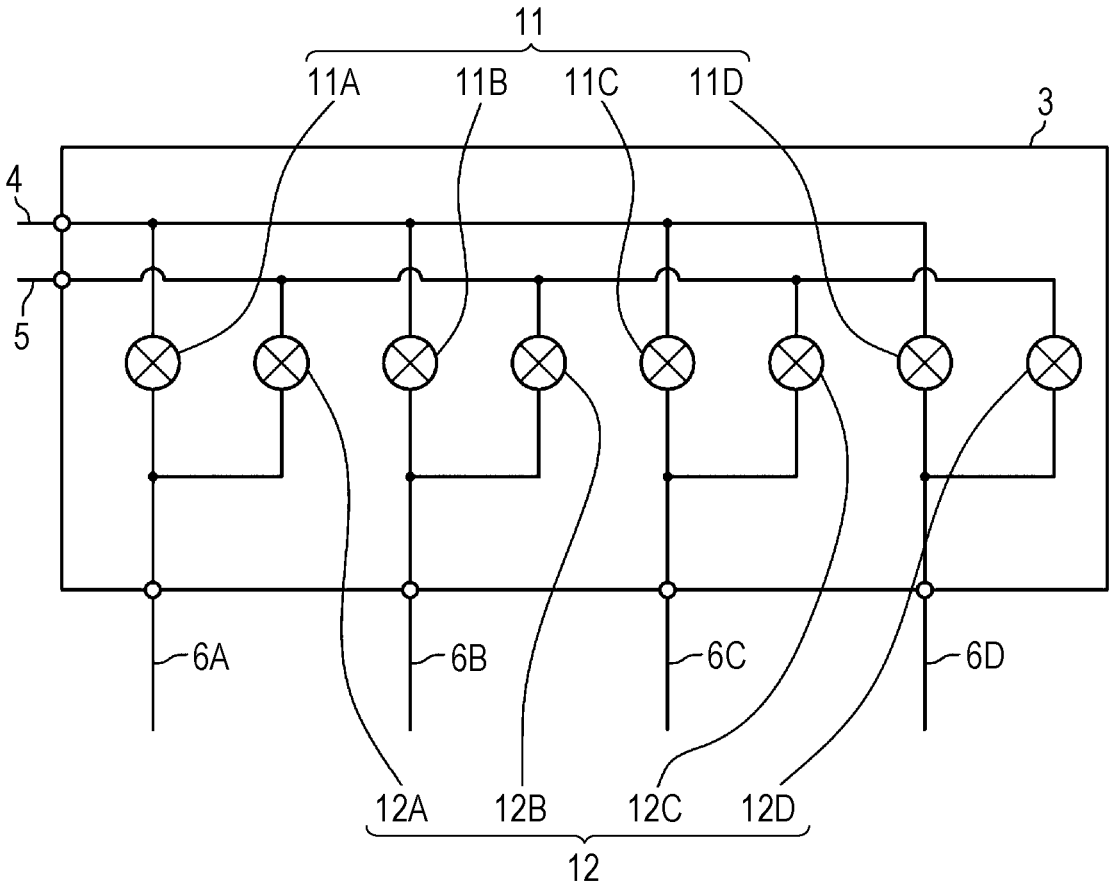
FIG. 2 is a refrigerant circuit diagram of the collective device for switching refrigerant flow according to the present embodiment.

An air conditioning system S using a collective device for switching refrigerant flow 3 according to the present embodiment will be described with reference to FIGS. 1 and 2. FIG. 1 is an entire configuration diagram of the air conditioning system S including the collective device for switching refrigerant flow 3 according to the present embodiment. FIG. 2 is a refrigerant circuit diagram of the collective device for switching refrigerant flow 3 according to the present embodiment.

As illustrated in FIG. 1, the air conditioning system S includes multiple indoor devices 1 (1A to 1D), an outdoor device 2, the collective device for switching refrigerant flow 3, a high-pressure gas pipe 4 connecting the outdoor device 2 and the collective device for switching refrigerant flow 3 to each other, a low-pressure gas pipe 5 connecting the outdoor device 2 and the collective device for switching refrigerant flow 3 to each other, a gas pipe 6 (6A to 6D) connecting the collective device for switching refrigerant flow 3 and each indoor device 1 (1A to 1D), and a liquid pipe 7 connecting each indoor device 1 (1A to 1D) and the outdoor device 2 to each other.

As illustrated in FIG. 2, in the collective device for switching refrigerant flow 3, a high-pressure valve 11 (11A to 11D) as an expansion valve is provided in the middle of a refrigerant flow path connecting the high-pressure gas pipe 4 and each gas pipe 6 (6A to 6D) to each other, and a low-pressure valve 12 (12A to 12D) as an expansion valve is provided in the middle of a refrigerant flow path connecting the low-pressure gas pipe 5 and each gas pipe 6 (6A to 6D) to each other.

With this configuration, the air conditioning system S is an air conditioning system configured to control opening/closing and the opening degrees of each high-pressure valve 11 (11A to 11D) and each low-pressure valve 12 (12A to 12D) of the collective device for switching refrigerant flow 3, thereby allowing cooling-heating simultaneous operation for independently performing cooling operation and heating operation of each indoor device 1 (1A to 1D). That is, the collective device for switching refrigerant flow 3 functions as a collective device for switching cooling and heating configured to switch each indoor device 1 (1A to 1D) between the cooling operation and the heating operation. Note that as illustrated in FIG. 1, the high-pressure gas pipe 4, the low-pressure gas pipe 5, and the gas pipes 6 (6A to 6D) are connected to the collective device for switching refrigerant flow 3, and the liquid pipe 7 directly connects each indoor device 1 (1A to 1D) and the outdoor device 2 to each other without the collective device for switching refrigerant flow 3.

<Collective Device for Switching Refrigerant Flow 3>

Figure 3:
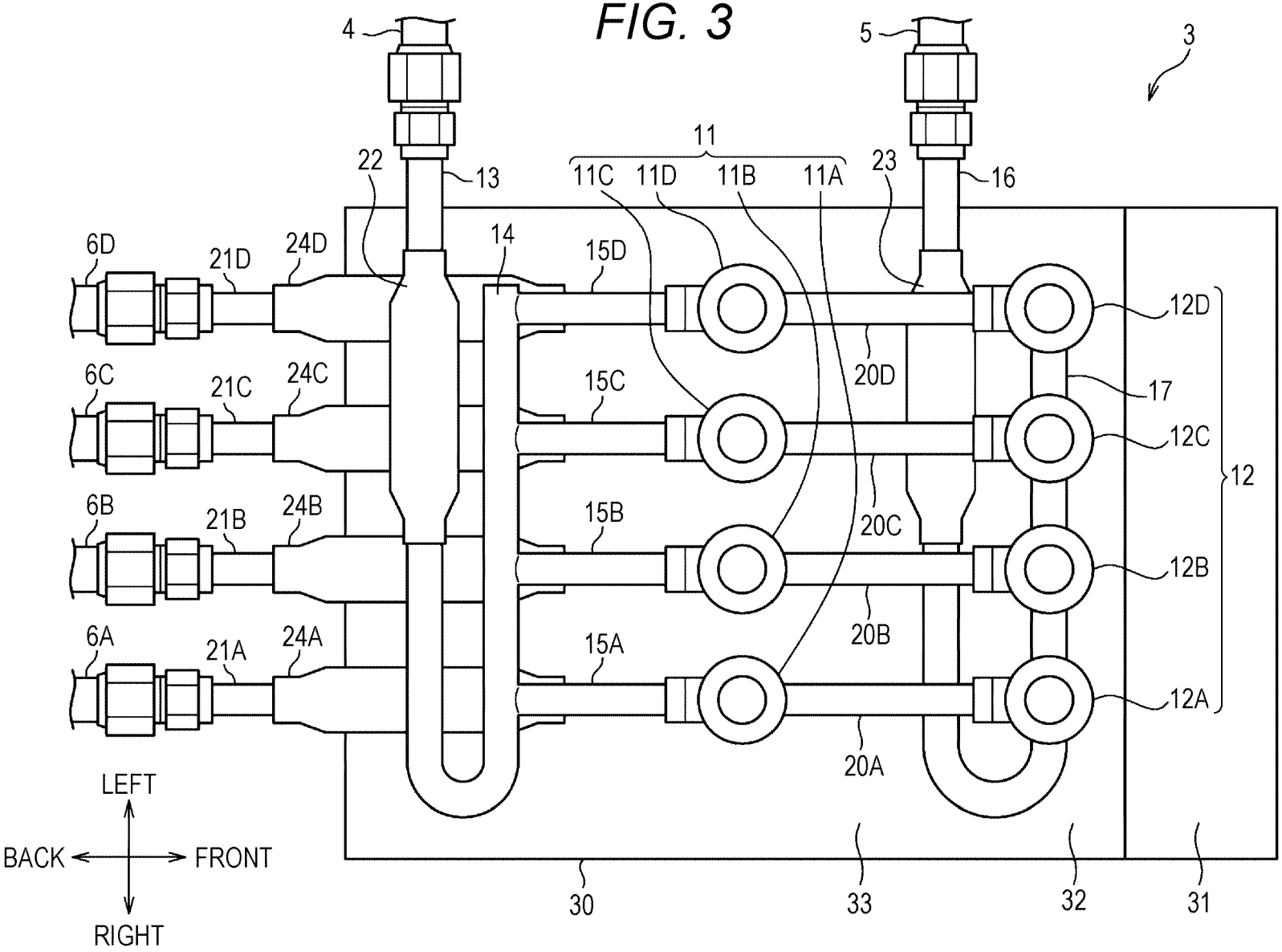
FIG. 3 is an upper view of the collective device for switching refrigerant flow according to the present embodiment.
Figure 4:
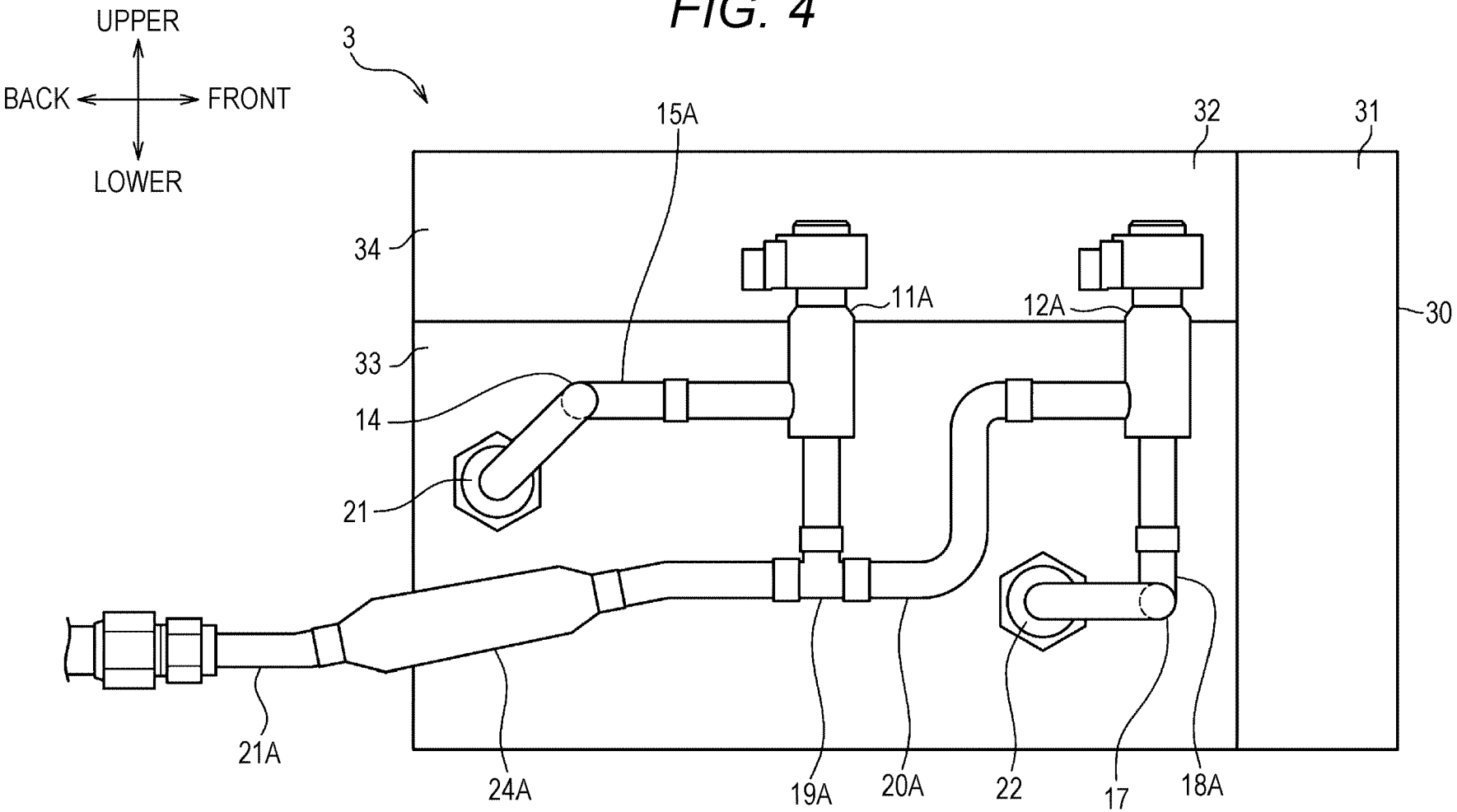
FIG. 4 is a right side view of the collective device for switching refrigerant flow according to the present embodiment.

Next, the collective device for switching refrigerant flow 3 will be described with reference to FIGS. 3 and 4. FIG. 3 is an upper view of the collective device for switching refrigerant flow 3 according to the present embodiment. FIG. 4 is a right side view of the collective device for switching refrigerant flow 3 according to the present embodiment. Note that FIGS. 3 and 4 illustrate the views seen through a near-side wall surface of a housing 30 and a foam thermal insulation 33. Moreover, in FIGS. 3 and 4, a vertical direction (a perpendicular direction) is taken as an upper-to-lower direction (see FIG. 4), a direction perpendicular to the upper-to-lower direction is taken as a front-to-back direction (see FIGS. 3 and 4), and a direction perpendicular to the upper-to-lower direction and the front-to-back direction is taken as a right-to-left direction (see FIG. 3).

The housing 30 of the collective device for switching refrigerant flow 3 is divided into an electronic equipment chamber 31 and a heat insulating chamber 32. An electronic circuit (not shown) for controlling the high-pressure valves 11 and the low-pressure valves 12 is arranged in the electronic equipment chamber 31.

The collective device for switching refrigerant flow 3 includes the high-pressure valves 11A to 11D, the low-pressure valves 12A to 12D, a high-pressure gas pipe 13, a high-pressure header 14, high-pressure gas pipes 15A to 15D, a low-pressure gas pipe 16, a low-pressure header 17, low-pressure gas pipes 18A to 18D, branched pipes 19A to 19D, connection gas pipes 20A to 20D, indoor gas pipes 21A to 21D, strainers 22, 23, 24A to 24D.

Moreover, the high-pressure valves 11A to 11D, the low-pressure valves 12A to 12D, the high-pressure header 14, the high-pressure gas pipes 15A to 15D, the low-pressure header 17, the low-pressure gas pipes 18A to 18D (only the low-pressure gas pipe 18A is illustrated in FIG. 4 by way of example), the branched pipes 19A to 19D (only the branched pipe 19A is illustrated in FIG. 4 by way of example), and the connection gas pipes 20A to 20D are arranged inside the heat insulating chamber 32. Moreover, the high-pressure gas pipe 13, the low-pressure gas pipe 16, and the indoor gas pipes 21A to 21D penetrate wall surfaces of the housing 30, and are arranged across the inside and outside of the heat insulating chamber 32. Further, the heat insulating chamber 32 is filled with the foam thermal insulation 33. Note that an upper portion of the heat insulating chamber 32 is a hollow portion 34 filled with no foam thermal insulation 33.

Valves with the same structure are used as the high-pressure valves 11 and the low-pressure valves 12, and the high-pressure valves 11 and the low-pressure valves 12 are electronic expansion valves whose opening/closing and opening degrees are controllable via the electronic circuit (not shown) of the electronic equipment chamber 31. As illustrated in FIG. 3, each of the high-pressure valves 11 and the low-pressure valves 12 has one port connected from the horizontal direction (a back direction), and the other port connected from the vertical direction (a lower direction). Moreover, lower portions (valve portions) of the high-pressure valves 11 and the low-pressure valves 12 are covered with the foam thermal insulation 33, and upper portions (electromagnetic coil portions for driving valve elements of the valve portions) of the high-pressure valves 11 and the low-pressure valves 12 are exposed through the foam thermal insulation 33 and are positioned at the hollow portion 34.

As illustrated in FIG. 3, the high-pressure valves 11A to 11D are arranged next to each other in the right-to-left direction (a first direction perpendicular to the vertical direction). Moreover, the low-pressure valves 12A to 12D are also arranged next to each other in the right-to-left direction (the first direction).

As illustrated in FIG. 3, the high-pressure valve 11A and the low-pressure valve 12A are arranged next to each other in the front-to-back direction (a second direction perpendicular to the vertical direction and the first direction). Moreover, as illustrated in FIG. 4, the high-pressure valve 11A and the low-pressure valve 12A are arranged such that the heights (the height positions of upper ends) of the high-pressure valve 11A and the low-pressure valve 12A are equal to each other. The same applies to the high-pressure valve 11B and the low-pressure valve 12B, the high-pressure valve 11C and the low-pressure valve 12C, and the high-pressure valve 11D and the low-pressure valve 12D.

The high-pressure gas pipe 13 has, on one end side, a connection metal fitting for connection to the high-pressure gas pipe 4, and on the other end side, is connected to the high-pressure header 14. The high-pressure header 14 is provided to extend in the same direction as a direction (the right-to-left direction, the first direction) in which the high-pressure valves 11 are arrayed.

The high-pressure gas pipe 15A extends in the front-to-back direction, and connects the high-pressure header 14 and one port of the high-pressure valve 11A to each other. Similarly, the high-pressure gas pipes 15B to 15D extend in the front-to-back direction, and connect the high-pressure header 14 and one ports of the high-pressure valves 11B to 11D.

The low-pressure gas pipe 16 has, on one end side, a connection metal fitting for connection to the low-pressure gas pipe 5, and on the other end side, is connected to the low-pressure header 17. The low-pressure header 17 is provided to extend in the same direction as a direction (the right-to-left direction, the first direction) in which the low-pressure valves 12 are arrayed.

The low-pressure gas pipe 18A extends in the upper-to-lower direction, and connects the low-pressure header 17 and the other port of the low-pressure valve 12A to each other. Similarly, the low-pressure gas pipes 18B to 18D (not shown) extend in the upper-to-lower direction, and connect the low-pressure header 17 and the other ports of the low-pressure valves 12B to 12D.

The branched pipe 19A is connected to the other port of the high-pressure valve 11A, and the connection gas pipe 20A and the indoor gas pipe 21A are connected thereto. Similarly, the branched pipes 19B to 19D (not shown) are each connected to the other ports of the high-pressure valves 11B to 11D, and the connection gas pipes 20B to 20D and the indoor gas pipes 21B to 21D are each connected thereto.

The connection gas pipe 20A has a rounded crank-shaped center line. One end side of the connection gas pipe 20A is connected to the other port of the high-pressure valve 11A via the branched pipe 19A, and the other end side of the connection gas pipe 20A is connected to one port of the low-pressure valve 12A. Similarly, one end sides of the connection gas pipes 20B to 20D are each connected to the other ports of the high-pressure valves 11B to 11D via the branched pipes 19B to 19D (not shown), and the other end sides of the connection gas pipes 20B to 20D are each connected to one ports of the low-pressure valves 12B to 12D.

The indoor gas pipe 21A has, on one end side, a connection metal fitting for connection to the gas pipe 6A, and on the other end side, is connected to the branched pipe 19A. Similarly, the indoor gas pipes 21B to 21D each have, on one end sides, connection metal fittings for connection to the gas pipes 6B to 6D, and on the other end sides, are each connected to the branched pipes 19B to 19D (not shown).

The strainer 22 is provided at the high-pressure gas pipe 13. Moreover, the strainer 23 is provided at the low-pressure gas pipe 16. Further, the strainers 24A to 24D are each provided at the indoor gas pipes 21A to 21D.

Note that the illustrated strainers 22, 23 are arranged inside the heat insulating chamber 32, and the illustrated strainers 24A to 24D are arranged across the inside and outside of the heat insulating chamber 32. However, the present embodiments are not limited to the above. The strainers 22, 23, 24A to 24D may be arranged inside the heat insulating chamber 32, may be arranged outside the heat insulating chamber 32, or may be arranged across the inside and outside of the heat insulating chamber 32.

As illustrated in FIG. 4, the assembly of the low-pressure gas pipe 16, the low-pressure header 17, the low-pressure gas pipes 18A to 18D, and the low-pressure valves 12A to 12D is, as viewed in the front-to-back direction (the second direction), arranged on a forward side (one side in the second direction) with respect to the assembly of the high-pressure gas pipe 13, the high-pressure header 14, the high-pressure gas pipes 15A to 15D, and the high-pressure valves 11A to 11D.

In other words, the assembly of the high-pressure gas pipe 13, the high-pressure header 14, the high-pressure gas pipes 15A to 15D, and the high-pressure valves 11A to 11D is arranged on a backward side (the other side in the second direction) with respect to the connection gas pipes 20A to 20D, and the assembly of the low-pressure gas pipe 16, the low-pressure header 17, the low-pressure gas pipes 18A to 18D, and the low-pressure valves 12A to 12D is arranged on the forward side (one side in the second direction) with respect to the connection gas pipes 20A to 20D.

With such arrangement, the collective device for switching refrigerant flow 3 according to the present embodiment can have such a structure that the low-pressure gas pipe 16 and the low-pressure header 17 do not pass below the high-pressure valves 11. As a result, downward projection can be reduced, and the height dimension of the collective device for switching refrigerant flow 3 can be reduced.

In addition, the high-pressure valves 11 and the low-pressure valves 12 are arranged such that the heights (the height positions of the upper ends) thereof are equal to each other. Thus, upward projection can be reduced, and the height dimension of the collective device for switching refrigerant flow 3 can be reduced. Moreover, the high-pressure valves 11 and the low-pressure valves 12 are arranged such that the heights (the height positions of the upper ends) thereof are equal to each other. Thus, the lower valve portions can be covered with the foam thermal insulation 33, and the upper electromagnetic coil portions can be exposed through the foam thermal insulation 33 and be arranged at the hollow portion 34. Consequently, connection to the electronic circuit (not shown) of the electronic equipment chamber 31 is facilitated.

With this configuration, the collective device for switching refrigerant flow 3 having the reduced height dimension and exhibiting better compactness can be provided. Moreover, since the height dimension is reduced, the volume of an internal space of the heat insulating chamber 32 filled with the foam thermal insulation 33 is also reduced. Thus, charging of the foam thermal insulation 33 is facilitated.

<<Modifications>>

Note that the collective device for switching refrigerant flow 3 according to the present embodiment is not limited to the configuration of the above-described embodiment, and various changes can be made without departing from the gist of the present disclosure.

The air conditioning system S has been described as the system including four indoor devices 1 (1A to 1D), and the collective device for switching refrigerant flow 3 has been described as the device including four refrigerant circuits (the assemblies of the high-pressure valve 11, the low-pressure valve 12, the high-pressure gas pipe 15, the low-pressure gas pipe 18, the branched pipe 19, the connection gas pipe 20, the indoor gas pipe 21, and the strainer 24) branched from the high-pressure header 14 and the low-pressure header 17. However, the present embodiment is not limited to above. The collective device for switching refrigerant flow 3 may include two or more assemblies of the high-pressure valve 11, the low-pressure valve 12, the high-pressure gas pipe 15, the low-pressure gas pipe 18, the branched pipe 19, the connection gas pipe 20, the indoor gas pipe 21, and the strainer 24.

What is claimed is:

1. A collective device for switching refrigerant flow arranged between an indoor device and an outdoor device, comprising:

multiple high-pressure valves;

multiple low-pressure valves;

a high-pressure header;

a low-pressure header;

a plurality of high-pressure gas pipes respectively connecting each high-pressure valve and the high-pressure header; and a plurality of low-pressure gas pipes respectively connecting each low-pressure valve and the low-pressure header; and a plurality of connection gas pipes respectively connecting each high-pressure valve to a respective low-pressure valve, wherein the multiple high-pressure valves are arranged next to each other in a first direction perpendicular to a vertical direction, wherein the multiple low-pressure valves are arranged next to each other in the first direction, wherein the low-pressure valves, the low-pressure header, and the low-pressure gas pipes are arranged on one side in a second direction perpendicular to the vertical direction and the first direction with respect to the high-pressure valves, the high-pressure header, and the high-pressure gas pipes, and wherein the connection gas pipes are respectively disposed extending in the second direction.

2. The collective device for switching refrigerant flow according to claim 1, wherein the high-pressure valves, the high-pressure header, and the high-pressure gas pipe are arranged on the other side in the second direction with respect to the connection gas pipe, and the low-pressure valves, the low-pressure header, and the low-pressure gas pipe are arranged on the one side in the second direction with respect to the connection gas pipe.

3. The collective device for switching refrigerant flow according to claim 2, wherein the high-pressure valves and the low-pressure valves are arranged at an identical height.

4. The collective device for switching refrigerant flow according to claim 3, wherein an inside of a housing of the device is filled with a foam thermal insulation.

5. The collective device for switching refrigerant flow according to claim 2, wherein an inside of a housing of the device is filled with a foam thermal insulation.

6. The collective device for switching refrigerant flow according to claim 1, wherein the high-pressure valves and the low-pressure valves are arranged at an identical height.

7. The collective device for switching refrigerant flow according to claim 6, wherein an inside of a housing of the device is filled with a foam thermal insulation.

8. The collective device for switching refrigerant flow according to claim 1, wherein an inside of a housing of the device is filled with a foam thermal insulation.

* * * * *